US006391846B1

(12) United States Patent
Berthod et al.

(10) Patent No.: US 6,391,846 B1
(45) Date of Patent: May 21, 2002

(54) PARTICULATE DETERGENT COMPOSITION CONTAINING ZEOLITE

(75) Inventors: Daniel Pierre Marie Berthod; Christophe Michel Bruno Joyeux; Johannes Hendrikus Langeveld, all of Vlaardingen (NL)

(73) Assignee: Unilever Home & Personal Care, USA. division of Conopco, Inc., Greenwich, CT (US)

( * ) Notice: Subject to any disclaimer, the term of this patent is extended or adjusted under 35 U.S.C. 154(b) by 149 days.

(21) Appl. No.: 09/590,315

(22) Filed: Jun. 8, 2000

(30) Foreign Application Priority Data

Jun. 10, 1999 (GB) ..... 9913547

(51) Int. Cl.[7] ..... C11D 3/08; C11D 17/06

(52) U.S. Cl. ..... 510/507; 510/349; 510/441; 510/443; 510/446; 510/452; 510/466; 510/508; 510/511; 510/531

(58) Field of Search ..... 510/349, 441, 510/443, 446, 452, 466, 507, 508, 511, 531

(56) References Cited

U.S. PATENT DOCUMENTS

| | | | | |
|---|---|---|---|---|
| 4,265,777 A | | 5/1981 | Boyer et al. | 252/113 |
| 5,583,093 A | | 12/1996 | Boskamp et al. | 510/351 |
| 5,691,296 A | * | 11/1997 | Agar et al. | 510/441 |
| 5,854,192 A | * | 12/1998 | Boskamp | 510/315 |
| 5,854,198 A | * | 12/1998 | Appel et al. | 510/444 |
| 6,191,095 B1 | * | 2/2001 | Emery et al. | 510/438 |
| 6,262,010 B1 | * | 7/2001 | Emery et al. | 510/446 |
| 6,303,558 B1 | * | 10/2001 | Emery et al. | 510/424 |

FOREIGN PATENT DOCUMENTS

| | | |
|---|---|---|
| EP | 0 384 070 | 8/1990 |
| EP | 0 521 726 | 1/1993 |
| EP | 0 522 726 | 1/1993 |
| EP | 0 544 492 | 6/1993 |
| EP | 739 977 | 10/1996 |
| EP | 799 884 | 10/1997 |
| WO | 94/13773 | 6/1994 |
| WO | 96/34084 | 10/1996 |
| WO | 98/54281 | 12/1998 |
| WO | 98/54286 | 12/1998 |
| WO | 98/54287 | 12/1998 |
| WO | 98/54288 | 12/1998 |

OTHER PUBLICATIONS

GB Search Report in a GB application GB 9913547.7 Oct. 1, 1999.
Derwent Abstract of JP 3084100—Apr. 9, 1991.
PCT International Search Report in a PCT application PCT/GB 00/02056. Sep. 21, 2000.
PCT International Search Report in a PCT application PCT/GB 00/02030. Sep. 20, 2000.

* cited by examiner

*Primary Examiner*—Mark Kopec
*Assistant Examiner*—Brian P. Mruk
(74) *Attorney, Agent, or Firm*—Rimma Mitelman

(57) ABSTRACT

A particulate zero-phosphate laundry detergent powder, preferably of bulk density 600–900 g/l, contains zeolite MAP and zeolite A in a weight ratio of at least 1:1. The powder may contain at least two different granular components containing organic surfactant and zeolite builder. A first granular component, which is preferably non-spray-dried and has a bulk density of 550–900 g/l, contains zeolite MAP, while a second granular component, which is preferably spray-dried and has a bulk density of 200–450 g/l, contains zeolite A.

20 Claims, No Drawings

PARTICULATE DETERGENT COMPOSITION CONTAINING ZEOLITE

TECHNICAL FIELD

The present invention relates to particulate laundry detergent compositions containing zeolite builder. More particularly the invention relates to zeolite-built compositions having bulk densities within the range of from 600 to 900 g/l.

1. Background

Particulate laundry detergent compositions of reduced or zero phosphate content containing zeolite builder are now well known and widely available. The original detergent zeolite was zeolite A, available in slurry, granule and powder forms, which has been used in low- and zero-phosphate laundry powders for many years. More recently, zeolite MAP (maximum aluminium zeolite P), as described and claimed in EP 384 070B (Unilever), has also become available.

Detergent powders normally consist of a principal homogeneous granular component, normally referred to as the base powder, containing at least organic surfactant and inorganic builder, and generally containing other robust ingredients. Traditionally the base powder has been prepared by spray-drying a slurry at elevated temperature to give porous crisp granules of low bulk density, for example 300 to 400 g/l. Heat sensitive and/or less robust ingredients such as bleaches, enzymes, antifoams and certain nonionic surfactants are then admixed (postdosed) to the base powder. Postdosing generally causes an increase in bulk density but values higher than about 550 g/l are rare.

In recent years "compact" or "concentrated" powders having a higher bulk density than is attainable by spray-drying and postdosing alone have become popular. In such powders, the base powder may be prepared by densifying a spray-dried powder, or by wholly non-tower processing (mechanical mixing). Concentrated base powders typically have a bulk density of at least 700 g/l. Postdosing of additional ingredients, as in traditional powders, can bring the bulk density up to 800 g/l or above.

Concentrated (non-tower) powders have various advantages, for example: their production consumes less energy and produces less pollution than does spray-drying; there is more freedom to incorporate a wide range of ingredients because heat sensitivity is less critical; the powders can be produced to a lower moisture content, so stability of moisture-sensitive ingredients such as sodium percarbonate is better. Spray-dried powders, on the other hand, tend to have better powder properties; they may be dosed into drum-type front-loading washing machines via the dispenser drawer, whereas non-tower powders generally require a dispensing device, and they disperse and dissolve in the wash liquor more quickly and completely. They also attract considerable consumer loyalty, for example, because the dosage amount and method are familiar.

Accordingly, while concentrated powders have become popular and offer many advantages, spray-dried powders have retained a considerable consumer following. There is therefore a need for powders which combine the advantages of both types of powders without the disadvantages. The manufacturer will also wish to be able to offer a selection of products ranging from conventional to concentrated. From the manufacturer's point of view, it is operationally advantageous if this can be done using a single common base powder, or at least as small a number of base powder variants as possible.

As described and claimed in EP 521 726A and EP 544 492B (Unilever), zeolite MAP has a better carrying capacity for mobile organic ingredients such as hydrophobic ethoxylated nonionic surfactants, which makes it significantly more suitable than zeolite A for formulating concentrated high-performance non-tower base powders, allowing higher surfactant loadings without loss of powder properties such as flow. Another advantage of zeolite MAP, as described and claimed in EP 522 726B (Unilever), is that, unlike zeolite A, it does not destabilise sodium percarbonate bleach, and allows the formulation of concentrated powders containing percarbonate. Zeolite MAP, therefore, is ideally suited for use in non-tower base powders of high quality.

However, zeolite MAP is not ideal for preparing spray-dried powders, tending to give dusty powders containing high levels of fine particles. It is also available only as a dried powder, so its use in a slurry-based process is uneconomic and wasteful of energy. The use of zeolite MAP to prepare powders of lower bulk density is therefore not preferred.

The present inventors have now discovered that it is possible for formulate powders of lower bulk densities based on a non-tower zeolite MAP base powder, if there is also included in the formulations a spray-dried zeolite A base powder, preferably in a minor amount. The resulting products have good powder properties and, surprisingly, the stability of sodium percarbonate is not compromised.

2. Prior art

WO 98 54288A (Unilever) discloses a particulate laundry detergent composition having a bulk density of at least 550 g/l, comprising a non-tower base powder and a spray-dried adjunct, wherein the non-tower base powder constitutes from 35 to 85 wt % of the total composition. The non-tower base powder may contain zeolite MAP. The spray-dried adjunct preferably comprises crystal-growth-modified sodium sesquicarbonate.

WO 98 54281A, WO 98 54286A and WO 98 54287A (Unilever) disclose a granular detergent component (adjunct) containing a high level of anionic surfactant, prepared by a flash-drying process. The adjunct contains 70 wt % linear alkylbenzene sulphonate, 20 wt % zeolite A, and 5 wt % of zeolite MAP. WO 96 34084A (Procter & Gamble/Dinniwell) discloses a low-dosage, highly dense detergent powder comprising about 40 to 80% by weight of spray-dried detergent granules, about 20 to 60% by weight of dense detergent agglomerates, and about 1 to 20% by weight of postdosed ingredients. Preferably the weight ratio of spray-dried granules to agglomerates is 1:1 to 3:1.

JP 03 084 100A (Lion) discloses a high bulk density detergent powder prepared by mixing spray-dried detergent particles, containing 20 to 50% by weight of anionic surfactant and 10 to 70% by weight of zeolite, with 1 to 15% by weight of separately prepared high bulk density detergent granules.

DEFINITION OF THE INVENTION

The present invention accordingly provides a particulate zero-phosphate laundry detergent composition containing zeolite MAP and zeolite A in a weight ratio of at least 1:1.

More particularly, the present invention provides a particulate zero-phosphate laundry detergent composition having a bulk density within the range of from 600 to 900 g/l, preferably from 650 to 800 g/l and most preferably from 650 to 750 g/l, containing zeolite MAP and zeolite A in a weight ratio of at least 1:1.

According to a preferred embodiment of the invention, the composition comprises at least two different granular components containing organic surfactant and zeolite builder, wherein a first granular component contains zeolite MAP and a second granular component contains zeolite A.

DETAILED DESCRIPTION OF THE INVENTION

The particulate laundry detergent composition of the invention contains zeolite MAP as the principal builder and also contains zeolite A, in a lesser amount.

The composition of the invention has a bulk density of from 600 to 900 g/l, preferably from 600 to 800 g/l and more preferably from 650 to 750 g/l.

The range of 650 to 750 g/l is lower than the range typical for concentrated powders but higher than that typical of powders prepared by spray-drying and postdosing only. Especially preferred compositions have a bulk density within the range of from 700 to 750 g/l. However, compositions according to the invention containing high levels of postdosed inorganic salts may have higher bulk densities.

A preferred composition of the invention comprises:

(i) a first granular component containing organic surfactant and zeolite MAP which is non-spray-dried and has a bulk density of from 550 to 950 g/l, preferably from 600 to 800 g/l;

ii) a second granular component containing organic surfactant and zeolite A which is spray-dried and has a bulk density of less than 500 g/l, preferably from 200 to 450 g/l, more preferably from 275 to 425 g/l.

The first granular component is a non-tower zeolite MAP base powder, and the second granular component is a spray-dried zeolite A base powder.

The first and second granular components are preferably present in a weight ratio of at least 1:1. Especially preferred is a weight ratio within the range of from 1.5:1 to 5:1.

Formulation of laundry detergent powders by this route enables a preferred bulk density to be chosen by suitable adjustment of the proportions of the two base powders.

The products of the invention have excellent powder properties. Flow properties are good and the proportion of fine particles below 180 micrometres is low: typically below 15 wt %. Dispensing into a front-loading automatic washing machine is excellent, giving negligible residues.

In general, the non-tower base powder has a larger average particle size and a smaller proportion of fine particles than does the spray-dried base powder. Without wishing to be bound by theory, it appears that the smaller spray-dried granules may act as filler particles to the larger non-tower granules, thus improving the flow properties and dispensing properties of the final product.

It is also believed that the presence of the highly soluble and quickly dissolving spray-dried base may aid dispersion and dissolution in the wash.

Without wishing to be bound by theory, it is believed that sequential dissolution of the spray-dried base (the second granular component) and the non-tower base (the first granular component) may occur. It is therefore advantageous if a soluble builder such as sodium citrate or acrylic/maleic polymer is present in the spray-dried base, for rapid release into the wash liquor before the bulk of the surfactants are delivered from the non-tower base.

Composition of the First Granular Component

The first granular component is a non-tower zeolite MAP base powder and preferably has a bulk density within the range of from 550 to 950 g/l, more preferably from 600 to 900 g/l, most preferably from 600 to 800 g/l.

It is preferred that the major proportion of organic surfactants to be included in the final composition should be incorporated in the first granular component. The high liquid carrying capacity of the zeolite MAP allows high loadings of mobile organic surfactants without detriment to powder properties. Any surfactants which are sensitive to heat and/or moisture, for example, nonionic surfactants, primary alcohol sulphates, glucamide, should be incorporated in the first granular component rather than in the second granular component.

In general, any ingredients suitable for base powder incorporation (as opposed to postdosing) which are sensitive to heat or to moisture or to both should be included in the first granular component.

Any supplementary inorganic builders of high liquid carrying capacity should be incorporated in the first granular component. An example of a supplementary inorganic builder having a high liquid carrying capacity is layered sodium silicate, for example, SKS-6 ex Clariant. Any supplementary builders that do not exhibit high liquid carrying capacity are more preferably incorporated in the second granular component.

Inorganic salts such as sodium carbonate or sodium sulphate may be incorporated in the first granular component. Salts of small particle size, for example light soda ash, should be incorporated by granulation in the first granular component, so that a final product having a low content of "fines" is achieved. Sodium sulphate may be incorporated in the first granular component if desired.

The first granular component preferably comprises from 10 to 30 wt % of organic surfactant, from 20 to 50 wt % of zeolite MAP, from 0 to 10 wt % of layered sodium silicate, from 10 to 45 wt % (in total) of sodium carbonate plus optional sodium sulphate, and optionally minor ingredients to 100 wt %, all percentages being based on the first granular component.

More preferably, the first granular component comprises from 10 to 25 wt % of anionic sulphonate or sulphate surfactant, from 5 to 20 wt % of ethoxylated nonionic surfactant, from 30 to 45 wt % of zeolite MAP, from 0 to 10 wt % of layered sodium silicate, from 15 to 30 wt % (in total) of sodium carbonate plus optional sodium sulphate, and optionally minor ingredients to 100 wt %.

The optional ingredients may be any suitable for incorporation into a non-tower base powder, and may, for example, be selected from fatty acid, fatty acid soap, polycarboxylate polymer, sodium citrate, fluorescers and antiredeposition agents.

Preparation of the First Granular Component

The first granular component may be prepared by any non-tower process suitable for the production of a zeolite MAP base powder.

In a preferred process, solid ingredients are granulated with a liquid binder in a high-speed mixer, and the resulting granules may then be transferred to a moderate-speed mixer. Preferred processes are described and claimed, for example, in EP 340 013A, EP 367 339A, EP 390 251A and EP 420 317A (Unilever).

These processes can be used to prepare base powders having bulk densities of, for example, 700 to 900 g/l. It has not generally proved possible to prepare base powders having bulk densities below 700 g/l using these processes.

According to one especially preferred embodiment of the invention, the process described and claimed in our copending British patent application of even date (Case C3932) may be used to prepare a zeolite MAP base powder having a bulk density below 700 g/l, for example, from 600 to 700 g/l.

This process comprises the steps of:

(i) mixing and agglomerating a liquid binder with a solid starting material in a high-speed mixer;

(ii) mixing the material from step (i) in a moderate- or low-speed mixer;

(iii) feeding the material from step (ii) and a liquid binder into a gas fluidisation granulator and further agglomerating, and (iv) optionally, drying and/or cooling.

Use of a zeolite MAP base powder of lower bulk density, prepared by this process, as the first granular component in the composition of the invention, allows the formulation of a lower bulk density detergent composition using a smaller proportion of the second granular component. The proportion of zeolite MAP, with its superior building and higher liquid carrying capacity, in the total zeolite builder is thus maximised.

Composition of the Second Granular Component

The second granular component is a spray-dried zeolite A base powder and has a bulk density below 500 g/l, preferably from 200 to 450 g/l, typically from 275 to 425 g/l. It may suitably comprise:

from 10 to 30 wt % of organic surfactant, from 20 to 50 wt % of zeolite A, from 10 to 45 wt % of other salts and polymer, and optionally minor ingredients to 100 wt %, all percentages being based on the second granular component.

The dissolution rate of the second granular component will be higher than that of the first granular component. It is advantageous for any soluble cobuilders to be incorporated in the second granular component, and for only a minority of the total surfactant of the formulation to be incorporated in the second granular component. In the wash liquor, the spray-dried second granular component will dissolve rapidly to lower the calcium ion concentration before the major part of the surfactant present is released from the more slowly dissolving first granular component.

According to an especially preferred embodiment of the invention, the second granular component comprises sodium citrate, in an amount of from 1 to 10 wt %, preferably from 2 to 5 wt %.

Alternatively or additionally, the second granular component may comprises a polycarboxylate polymer, preferably an acrylic polymer and more preferably an acrylic/maleic copolymer such as Sokalan (Trade Mark) CP5 ex BASF, in an amount of from 1 to 10 wt %, preferably from 3 to 8 wt %.

The second granular component may further comprise sodium silicate, generally incorporated in solution form. The sodium silicate may, for example, be present in an amount of from 0.5 to 10 wt %, preferably from 1 to 5 wt %.

More preferably, the second granular component comprises:

from 10 to 25 wt % of anionic sulphonate or sulphate surfactant, from 1 to 10 wt % of ethoxylated nonionic surfactant, from 25 to 45 wt % of zeolite A, from 1 to 10 wt % of sodium citrate, from 1 to 10 wt % of acrylic or acrylic/maleic polymer, from 0.5 to 10 wt % of sodium silicate, from 15 to 40 wt % of other salts, and optionally minor ingredients to 100 wt %.

The other salts may include sodium sulphate, which may be incorporated in the first or second granular component, or in both, and/or may be postdosed. In formulations in which the amount of sodium sulphate is not to exceed a certain level, any sodium sulphate present is preferably incorporated in the second granular component.

The second granular component may contain optional minor ingredients suitable for incorporation into a spray-dried base powder. These may, for example, be selected from fatty acid, fatty acid soap, fluorescers and antiredeposition agents.

Preparation of the Second Granular Component

The second granular component may be prepared by traditional slurry making and spray-drying methods, well known to the skilled detergent powder formulator.

The Detergent Composition

As indicated above, the particulate laundry detergent composition which is a preferred embodiment of the invention contains both a zeolite MAP non-tower base powder (the first granular component) and a zeolite A spray-dried base powder (the second granular component), preferably in a ratio of at least 1:1 and more preferably in a ratio of from 1.5:1 to 5:1.

The detergent composition may suitably comprise:

(i) from 30 to 60 wt %, preferably from 35 to 55 wt %, of the first granular component, (ii) from 10 to 40 wt %, preferably from 10 to 25 wt %, of the second granular component, (iii) optionally other admixed detergent ingredients to 100 wt %.

The other admixed detergent ingredients may suitably be selected from surfactant granules, bleach ingredients, antifoams, fluorescers, antiredeposition agents, soil release agents, dye transfer inhibiting agents, fabric conditioning agents, enzymes, perfumes, inorganic salts and combinations thereof.

The admixed detergent ingredients may include sodium percarbonate. Surprisingly, the storage stability of sodium percarbonate does not appear to be compromised by the presence of the zeolite A base powder.

Detergent Ingredients

As previously indicated, detergent compositions of the invention contain detergent-active compounds and detergency builders, and may optionally contain bleaching components and other active ingredients to enhance performance and properties.

Detergent-active compounds (surfactants) may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds. The total amount of surfactant present is suitably within the range of from 5 to 40 wt %.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ is primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+X^-$ wherein the R groups are long or short hydrocarbyl chains, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

Detergent compositions suitable for use in most automatic fabric washing machines generally contain anionic non-soap surfactant, or nonionic surfactant, or combinations of the two in any ratio, optionally together with cationic, amphoteric or zwitterionic surfactants, optionally together with soap.

The detergent compositions of the invention also contain one or more detergency builders. The total amount of detergency builder in the compositions will suitably range from 5 to 80 wt %, preferably from 10 to 60 wt %.

The zeolite builders may suitably be present in a total amount of from 5 to 60 wt %, preferably from 10 to 50 wt %. Amounts of from 10 to 45 wt % are especially suitable for particulate (machine) laundry detergent compositions.

The zeolites may be supplemented by other inorganic builders, for example, amorphous aluminosilicates, or layered silicates such as SKS-6 ex Clariant. Sodium carbonate, already listed as a possible ingredient, may also act in part as a builder. Phosphate builders, however, are preferably absent.

The zeolites may be supplemented by organic builders, for example, polycarboxylate polymers such as polyacrylates and acrylic/maleic copolymers; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

These lists of builders are not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %. Builders, both inorganic and organic, are preferably present in alkali metal salt, especially sodium salt, form.

Detergent compositions according to the invention may also suitably contain a bleach system. Preferably this will include a peroxy bleach compound, for example, an inorganic persalt or an organic peroxyacid, capable of yielding hydrogen peroxide in aqueous solution.

Preferred inorganic persalts are sodium perborate monohydrate and tetrahydrate, and sodium percarbonate, the latter being especially preferred. The sodium percarbonate may have a protective coating against destabilisation by moisture. The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %. Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabiliser (heavy metal sequestrant) may also be present. Suitable bleach stabilisers include ethylenediamine tetraacetate (EDTA), diethylenetriamine pentaacetate (DTPA), ethylenediamine disuccinate (EDDS), and the polyphosphonates such as the Dequests (Trade Mark), ethylenediamine tetramethylene phosphonate (EDTMP) and diethylenetriamine pentamethylene phosphate (DETPMP).

The compositions of the invention may contain alkali metal, preferably sodium, carbonate, in order to increase detergency and ease processing. Sodium carbonate may suitably be present in amounts ranging from 1 to 60 wt %, preferably from 2 to 40 wt %.

As previously indicated, sodium silicate may also be present. The amount of sodium silicate may suitably range from 0.1 to 5 wt %. Sodium silicate, as previously indicated, is preferably introduced via the second granular component.

Powder flow may be improved by the incorporation of a small amount of a powder structurant. Examples of powder structurants, some of which may play other roles in the formulation as previously indicated, include, for example, fatty acids (or fatty acid soaps), sugars, acrylate or acrylate/maleate polymers, sodium silicate, and dicarboxylic acids (for example, Sokalan (Trade Mark) DCS ex BASF). One preferred powder structurant is fatty acid soap, suitably present in an amount of from 1 to 5 wt %.

Other materials that may be present in detergent compositions of the invention include antiredeposition agents such as cellulosic polymers; soil release agents; anti-dye-transfer agents; fluorescers; inorganic salts such as sodium sulphate; enzymes (proteases, lipases, amylases, cellulases); dyes; coloured speckles; perfumes; and fabric conditioning compounds. This list is not intended to be exhaustive.

EXAMPLES

The invention is further illustrated by the following non-limiting Examples, in which parts and percentages are by weight unless otherwise stated.

Measurement of Dynamic Flow Rate (DFR)

The apparatus used consists of a cylindrical glass tube having an internal diameter of 35 mm and a length of 600 mm. The tube is securely clamped in a position such that its longitudinal axis is vertical. Its lower end is terminated by means of a smooth cone of polyvinyl chloride having an internal angle of 15° and a lower outlet orifice of diameter 22.5 mm. A first beam sensor is positioned 150 mm above the outlet, and a second beam sensor is positioned 250 mm above the first sensor.

To determine the dynamic flow rate of a powder sample, the outlet orifice is temporarily closed, for example, by covering with a piece of card, and powder is poured through a funnel into the top of the cylinder until the powder level is about 10 cm higher than the upper sensor; a spacer between the funnel and the tube ensures that filling is uniform. The outlet is then opened and the time t (seconds) taken for the powder level to fall from the upper sensor to the lower sensor is measured electronically. The measurement is normally repeated two or three times and an average value taken. If V is the volume (ml) of the tube between the upper and lower sensors, the dynamic flow rate DFR (ml/s) is given by the following equation:

$$DFR = \frac{V}{t} \text{ml/s}$$

The averaging and calculation are carried out electronically and a direct read-out of the DFR value obtained.

Measurement of Dispenser Residues

For the purposes of the present invention, dispensing into an automatic washing machine is assessed by means of a standard procedure using a test rig based on the main wash compartment of the dispenser drawer of the Philips (Trade Mark) AWB 126/7 washing machine. This drawer design provides an especially stringent test of dispensing characteristics especially when used under conditions of low temperature, low water pressure and low rate of water flow.

The drawer is of generally cuboidal shape and consists of a main compartment, plus a small front compartment and a separate compartment for fabric conditioner which play no part in the test. In the test, a 100 g dose of powder is placed in a heap at the front end of the main compartment of the drawer, and subjected to a controlled water fill of 5 liters at 10° C. and an inlet pressure of 50 kPa, flowing in over a period of 1 minute. The water enters through 2 mm diameter holes in a plate above the drawer: some water enters the front compartment and therefore does not reach the powder. Powder and water in principle leave the drawer at the rear end which is open.

After 1 minute the flow of water is ceased, and the powder remaining is then collected and dried at 90° C. to constant weight. The dry weight of powder recovered from the dispenser drawer, in grams, represents the weight percentage of powder not dispensed into the machine (the residue). Every result is the average of two duplicate measurements.

Abbreviations

The following abbreviations are used for ingredients used in the Examples:

| | |
|---|---|
| LAS | Linear alkylbenzene sulphonate |
| Nonionic 7EO | $C_{12-15}$ alcohol ethoxylated with an average of 7 moles of ethylene oxide per mole |
| Ca EDTMP | Calcium salt of ethylenediamine tetramethylene phosphonate |
| TAED | Tetraacetyl ethylenediamine |

Example 1

Base Powders

Three base powders were prepared as follows:

Non-tower base powder B1 was prepared as follows:

(i) mixing and granulating solid starting materials consisting of zeolite MAP, light soda ash, sodium carboxymethylcellulose (SCMC) and sodium citrate with "liquid binder" (LAS acid, nonionic surfactant, fatty acid/soap—see below) in a Lödige Recycler (CB 30) high-speed mixer;

(ii) transferring the material from the Recycler to a Lödige Ploughshare (KM 300) moderate-speed mixer;

(iii) transferring the material from the Ploughshare to a Vometec (Trade mark) fluid bed operating as a gas fluidisation granulator, adding further "liquid binder" and agglomerating; and (iv) finally drying/cooling the product in the fluid bed.

The conditions in steps (i) to (iii) were as follows:

| | |
|---|---|
| (i) Lödige Recycler (CB 30) | |
| Residence time: | about 15 seconds |
| Shaft rotation speed: | 1000 rpm |
| Tip speed: | 15.7 m/s |
| Froude number: | 168 |
| (ii) Lödige Ploughshare (KM 300) | |
| Residence time: | about 3 minutes |
| Shaft rotation speed: | 100 rpm |
| Choppers: | Switched off |
| Tip speed: | 2.62 m/s |
| Froude number: | 2.8 |
| Liquid binder: | None added |
| (iii) Fluid bed (batch Vomotec apparatus, batch size 10 kg) | |
| Superficial air velocity | 1.0 m/s |
| Fluidisation gas temperature: | 75° C. |
| Atomisation gas temperature: | Hot |
| Atomisation air pressure: | 3.5 bar |
| Height of nozzle (above distributor plate): | 47 cm |
| Rate of spray-on of binder: | 800 g/min |

The "liquid binder" used in steps (i) and (iii) was a structured blend comprising the anionic surfactant, nonionic surfactant and soap components of the base powder. The blend was prepared by mixing 38.44 parts by weight of LAS acid precursor and 5.20 parts by weight fatty acid in the presence of 41.60 parts by weight of ethoxylated nonionic surfactant in a blend-loop and neutralising with 14.75 parts of a sodium hydroxide solution. The blend temperature in the loop was controlled by a heat-exchanger. The neutralising agent was a sodium hydroxide solution.

The resulting blend had the following composition:

| | |
|---|---|
| Na-LAS | 39.9 |
| Nonionic surfactant (7EO) | 41.6 |
| Soap | 5.6 |
| Water | 12.9 |

Non-tower base powder B2 of higher bulk density than B1, was prepared by non-tower granulation as described, for example, in EP 340 013A, EP 367 339A, EP 390 251A and EP 420 317A (Unilever): solid and liquid ingredients were granulated continuously in a high-speed mixer (Lödige CB30 Recycler).

Spray-dried base powder S1 was prepared by a conventional slurry-making and spray-drying process.

The formulations and powder properties of the base powders were as shown in the table below.

| | B2 | B1 | S1 |
|---|---|---|---|
| LAS (as acid) | 11.70 | 11.84 | |
| LAS | | | 12.18 |
| Nonionic 7EO | 14.50 | 12.81 | 3.52 |
| Soap/fatty acid | 1.90 | 1.73 | 4.00 |
| Zeolite A (100%) | | | 32.00 |
| Zeolite MAP (100%) | 36.50 | 36.10 | |
| Acrylic/maleic copolymer | | | 6.00 |
| Sodium citrate 2aq | 3.00 | 3.33 | 4.00 |
| Sodium silicate (100%) | | | 1.20 |

-continued

| | B2 | B1 | S1 |
|---|---|---|---|
| Sodium carbonate light | 24.50 | 24.96 | |
| Sodium carboxymethyl cellulose (68.5%) | 0.90 | 0.81 | 0.80 |
| Sodium sulphate | | | 25.20 |
| Moisture and salts | 7.00 | 8.42 | 11.10 |
| Total | 100.00 | 100.00 | 100.00 |
| Bulk density (g/l) | 735–755 | 600–650 | 310–395 |
| DFR (ml/s) | ca 130 | ca 125 | 60–90 |
| Average particle size | ca 625 | 550–650 | 345–460 |
| Fines (<180 micrometres) | 6.3–8.9 | 5–10 | 14–22 |
| Oversize (>1.4 mm) | 1.1–3.8 | <2 | 1.5 |
| Dispensing at 10° C. | 0–2 | 0 | 0 |

Examples 2 and 3

Particulate Detergent Compositions

Fully formulated detergent compositions were prepared by mixing a non-tower base powder B1 or B2 with the spray-dried base powder S1, and postdosing further ingredients.

Formulations and powder properties are shown below.

TABLE 1 outline formulations

| | Example 2 | Example 3 |
|---|---|---|
| Base powder B2 | 39 | |
| Base powder B1 | | 45 |
| Base powder S1 | 22 | 16 |
| Postdosed ingredients | 39 | 39 |

TABLE 2 full formulations

| | Example 2 | Example 3 |
|---|---|---|
| LAS (as acid) | 4.56 | 1.95 |
| LAS | 2.68 | 5.33 |
| Nonionic 7EO | 6.43 | 6.33 |
| Soap/fatty acid | 1.62 | 1.42 |
| Zeolite A (100%) | 7.04 | 5.12 |
| Zeolite MAP (100%) | 14.24 | 16.25 |
| Acrylic/maleic copolymer | 1.32 | 0.96 |
| Sodium citrate 2aq | 2.05 | 2.14 |
| Sodium silicate (100%) | 0.26 | 0.19 |
| Sodium carbonate light | 9.56 | 11.23 |
| Sodium carboxymethylcellulose (68.5%) | 0.53 | 0.49 |
| Sodium sulphate | 5.54 | 4.03 |
| Moisture and salts | 5.17 | 5.57 |
| Subtotal for base powders | 61.00 | 61.00 |
| Sodium percarbonate | 10.50 | 10.50 |
| TAED (83%) | 1.30 | 1.30 |
| Silicone antifoam granule | 1.15 | 1.15 |
| Fluorescer adjunct (15%) | 0.80 | 0.80 |
| Ca EDTMP (34%) | 0.60 | 0.60 |
| Sodium carbonate (dense) | 11.00 | 11.36 |
| Sodium bicarbonate | 7.98 | 7.65 |
| Carbonate/silicate granules | 4.50 | 4.50 |
| Protease (Savinase 12.0 TXT) | 0.18 | 0.18 |
| Acrylic/maleic copolymer (gran) | 0.68 | 0.65 |
| Perfume | 0.31 | 0.31 |
| Total | 100.00 | 100.00 |

TABLE 3 powder properties

| | Example 2 | Example 3 |
|---|---|---|
| Bulk density (g/l) | 700–750 | 700–720 |
| DFR (ml/s) | >90 | >90 |
| Average particle size | 550–600 | 550–600 |
| Fines (<180 micrometers) (wt %) | 10–15 | 10–15 |
| Oversize (>1.4 mm) (wt %) | ca 1.5 | ca 2 |
| Dispensing at 10° C. (wt %) | 0–5 | 0–5 |

We claim:

1. A particulate zero-phosphate laundry detergent composition containing at least two different granular components containing organic surfactant and zeolite builder, wherein a first granulate component contains zeolite MAP and a second granular component contains zeolite A, and wherein the detergent composition contains zeolite MAP and zeolite A in a weight ratio of at least 1:1.

2. A detergent composition as claimed in claim 1, having a bulk density within the range of from 600 to 900 g/l.

3. A detergent composition as claimed in claim 2, having a bulk density within the range of from 600 to 800 g/l.

4. A detergent composition as claimed in claim 3, having a bulk density of from 650 to 750 g/l.

5. A detergent composition as claimed in claim 1, which comprises (i) a first granular component containing organic surfactant and zeolite MAP which is non-spray-dried and has a bulk density of from 550 to 950 g/l, (ii) a second granular component containing organic surfactant and zeolite A which is spray-dried and has a bulk density of less than 500 g/l.

6. A detergent composition as claimed in claim 1, wherein the first granular component has a bulk density within the range of from 600 to 800 g/l.

7. A detergent composition as claimed in claim 1, wherein the second granular component has a bulk density within the range of from 200 to 450 g/l.

8. A detergent composition as claimed in claim 1, wherein the second granular component has a bulk density within the range of from 275 to 425 g/l.

9. A detergent composition as claimed in claim 1, wherein the first and second granular components are present in a weight ratio of at least 1:1.

10. A detergent composition as claimed in claim 1, wherein the first and second granular components are present in a weight ratio within the range of from 1.5:1 to 5:1.

11. A detergent composition as claimed in claim 1, wherein the first granular component comprises:

from 10 to 30 wt % of organic surfactant, from 20 to 50 wt % of zeolite MAP, from 0 to 10 wt % of layered sodium silicate, from 10 to 45 wt % of sodium carbonate plus optional sodium sulphate, and optionally minor ingredients to 100 wt %, all percentages being based on the first granular component.

12. A detergent composition as claimed in claim 1, wherein the first granular component comprises:

from 10 to 25 wt % of anionic sulphonate or sulphate surfactant, from 5 to 20 wt % of ethoxylated nonionic surfactant, from 30 to 45 wt % of zeolite MAP, from 0 to 10 wt % of layered sodium silicate, from 15 to 30 wt % of sodium carbonate plus optional sodium sulphate, and optionally minor ingredients to 100 wt %.

13. A detergent composition as claimed in claim 1, wherein the first granular component contains minor ingredients selected from fatty acid, fatty acid soap, polycarboxylate polymer, sodium citrate, fluorescers and antiredeposition agents.

14. A detergent composition as claimed in claim 1, wherein the second granular component comprises:

from 10 to 30 wt % of organic surfactant, from 20 to 50 wt % of zeolite A, from 10 to 45 wt % of other salts, and optionally minor ingredients to 100 wt %, all percentages being based on the second granular component.

15. A detergent composition as claimed in claim 1, wherein the second granular component comprises:

from 10 to 25 wt % of anionic sulphonate or sulphate surfactant, from 1 to 10 wt % of ethoxylated nonionic surfactant, from 25 to 45 wt % of zeolite A, from 1 to 10 wt % of sodium citrate, from 0 to 10 wt % of acrylic or acrylic/maleic polymer, from 0.5 to 10 wt % of sodium silicate, from 15 to 40 wt % of other salts, and optionally minor ingredients to 100 wt %.

16. A detergent composition as claimed in claim 1, wherein the second granular component contains minor ingredients selected from the group consisting of fatty acid, fatty acid soap, fluorescers and antiredeposition agents.

17. A detergent composition as claimed in claim 1, which comprises (i) from 30 to 60 wt % of the first granular component, (ii) from 10 to 40 wt % of the second granular component, (iii) optionally other admixed detergent ingredients to 100 wt %.

18. A detergent composition as claimed in claim 1, which comprises (i) from 35 to 55 wt % of the first granular component, (ii) from 10 to 25 wt % of the second granular component, (iii) optionally other admixed detergent ingredients to 100 wt %.

19. A detergent composition as claimed in claim 1, which comprises (iii) other admixed detergent ingredients selected from surfactant granules, bleach ingredients, antifoams, fluorescers, antiredeposition agents, soil release agents, dye transfer inhibiting agents, fabric conditioning agents, enzymes, perfumes, inorganic salts and combinations thereof.

20. A detergent composition as claimed in claim 1, which contains sodium percarbonate.

* * * * *